US009861150B2

(12) United States Patent
Lovell

(10) Patent No.: US 9,861,150 B2
(45) Date of Patent: Jan. 9, 2018

(54) ASSEMBLY FOR COVERING A HEAD

(71) Applicant: Karin Kristi Lovell, Ocala, FL (US)

(72) Inventor: Karin Kristi Lovell, Ocala, FL (US)

( * ) Notice: Subject to any disclaimer, the term of this patent is extended or adjusted under 35 U.S.C. 154(b) by 5 days.

(21) Appl. No.: 15/050,951

(22) Filed: Feb. 23, 2016

(65) Prior Publication Data

US 2017/0224041 A1 Aug. 10, 2017

Related U.S. Application Data

(60) Provisional application No. 62/292,982, filed on Feb. 9, 2016.

(51) Int. Cl.
*A42B 1/04* (2006.01)
*A42B 1/24* (2006.01)

(52) U.S. Cl.
CPC ..... *A42B 1/247* (2013.01)

(58) Field of Classification Search
CPC ..... A42B 1/041; A42B 1/046; A42B 1/24; A42B 1/02; A42B 1/247; A42B 1/12; A42B 3/228; A61F 9/027; G02C 3/02
USPC ..... 2/171, 173, 209.13, 175.1, 10, 68, 6.3, 2/452; 351/155
See application file for complete search history.

(56) References Cited

U.S. PATENT DOCUMENTS

| | | | |
|---|---|---|---|
| 1,144,121 | A | 6/1915 | Guinzburg |
| 1,156,238 | A | 10/1915 | Litchfield |
| 1,390,628 | A | 9/1921 | Litchfield |
| 1,463,926 | A | 8/1928 | Schneidt |
| 2,362,775 | A | 11/1944 | Dickran |
| 2,705,802 | A | 4/1955 | Tellier |
| 3,653,086 | A | 4/1972 | Gongwer |
| 3,755,819 | A | 9/1973 | Douglas |
| 4,029,092 | A | 6/1977 | Morgan |
| 4,279,039 | A | 7/1981 | Drew |
| 4,768,231 | A | 9/1988 | Schrack |

(Continued)

FOREIGN PATENT DOCUMENTS

| | | |
|---|---|---|
| WO | 2011/113480 | 9/2011 |
| WO | 2012/164299 | 12/2012 |
| WO | 2013/167697 | 11/2013 |

OTHER PUBLICATIONS http://www.tropicalsnorkeling.com/snorkeling-swim-cap.html.
https://www.extreme-exposure.com/node/1681.
http://www.amazon.com/Tilos-Metal-Light-Neoprene-Adjustable-Swimming/dp/B00104OHRM/ref=sr_1_2?s=sporting-goods&ie=UTF8&qid=1418515609&sr=1-2&keywords=snorkel+cap.

*Primary Examiner* — Tejash Patel
(74) *Attorney, Agent, or Firm* — Cian G. O'Brien; Beusse, Wolter, Sanks & Maire PLLC

(57) ABSTRACT

An assembly is presented for covering a head of a wearer of an eye mask. The eye mask includes a mask strap to secure the eye mask around the head. The assembly includes a head covering to cover at least a portion of the head, with a first slot extending from a left side to a right side of the covering. A strap is received within the first slot such that opposing ends of the strap are operatively connected to the mask strap on the left side and right side of the covering. The head covering may also include a second slot that extends along a rear side of the covering to receive the mask strap such that the mask strap extends from a left side to a right side of the covering through the rear slot. A method is also presented for wearing the head covering and the eye mask.

20 Claims, 4 Drawing Sheets

(56) References Cited

U.S. PATENT DOCUMENTS

| | | | | | |
|---|---|---|---|---|---|
| 4,912,777 | A * | 4/1990 | Gasbarro | A42B 1/12 | 2/2.15 |
| 5,287,559 | A | 2/1994 | Christiansen | | |
| 5,384,605 | A * | 1/1995 | Escobosa | G02C 3/003 | 2/452 |
| 5,431,156 | A | 7/1995 | Sundstrom | | |
| 5,488,441 | A * | 1/1996 | Pomatti | G02C 11/00 | 2/452 |
| 5,575,009 | A | 11/1996 | Ryvin | | |
| 5,845,341 | A * | 12/1998 | Barthold | A42B 3/04 | 2/10 |
| 5,862,524 | A | 1/1999 | Case | | |
| 6,038,706 | A * | 3/2000 | Seiler | A45C 11/04 | 2/426 |
| 6,085,359 | A | 7/2000 | Viola | | |
| 6,644,807 | B1 | 11/2003 | Hood | | |
| 6,647,554 | B1 | 11/2003 | Yan | | |
| 6,763,835 | B1 | 7/2004 | Grove et al. | | |
| 7,255,436 | B2 * | 8/2007 | Tracy | G02C 3/02 | 2/209.13 |
| 8,209,778 | B2 | 7/2012 | Matsumoto | | |
| 8,359,662 | B2 | 1/2013 | Viljanen | | |
| 2002/0124299 | A1 | 9/2002 | Malcolm | | |
| 2009/0276940 | A1 | 11/2009 | Sallee | | |
| 2014/0190476 | A1 | 7/2014 | Stinton | | |
| 2015/0103307 | A1 * | 4/2015 | McPhail | G02C 5/001 | 351/156 |

* cited by examiner

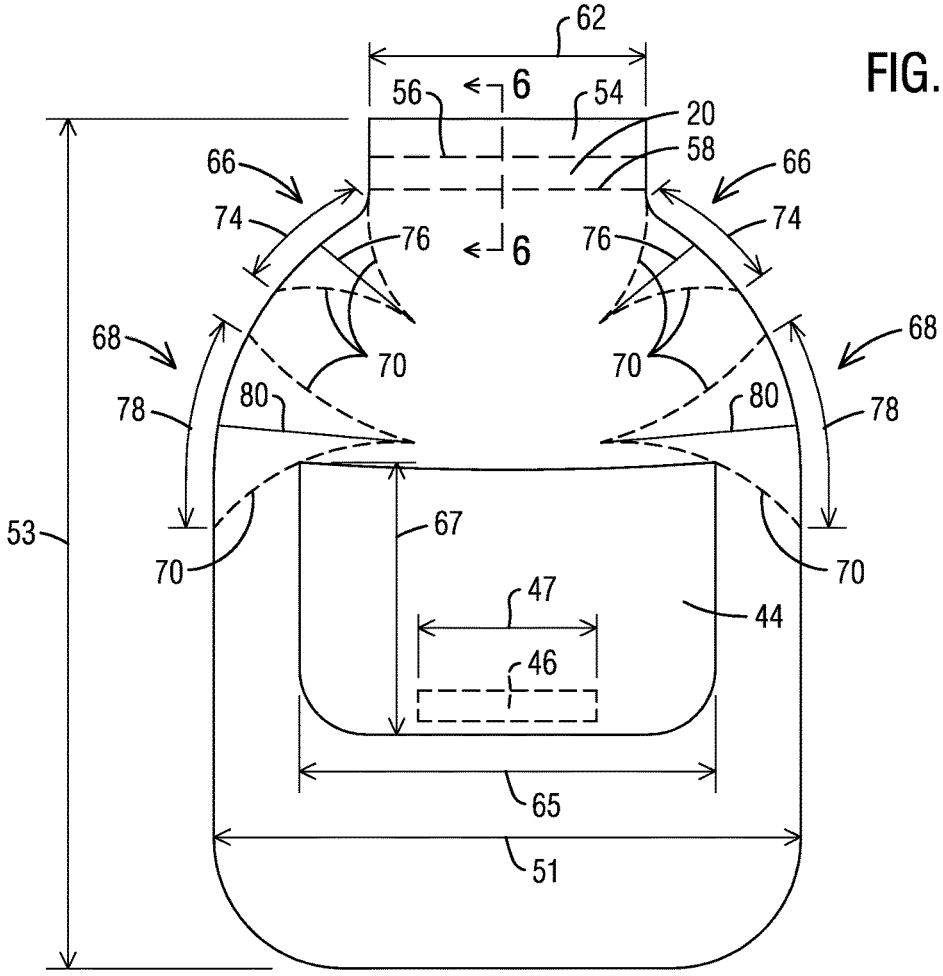
FIG. 5
FIG. 6A
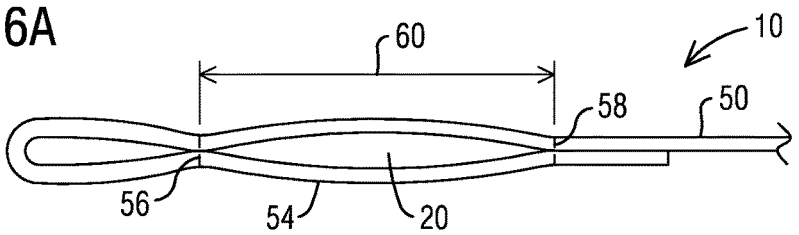
FIG. 6B
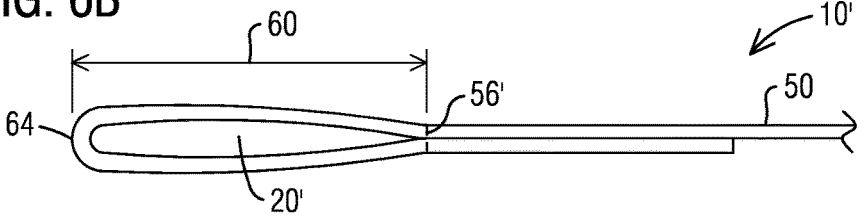

ASSEMBLY FOR COVERING A HEAD

BACKGROUND OF THE INVENTION

Several types of head coverings have been developed for use with eye masks, such as, for example, swimming caps used with eye goggles during aquatic activities and surgical caps used with surgical goggles during medical procedures. These head coverings protect the head from external factors, such as sun exposure during aquatic activities or biological contamination during medical procedures. Additionally, these head coverings retain the hair so that the hair does not impede vision, such as vision during snorkeling through the water during aquatic activities or vision during a medical procedure.

Although conventional head coverings are provided for use with eye masks, these head covering have several drawbacks. For example, since the head coverings and eye masks are separate articles, they must be worn in separate stages. This is time consuming, particularly when repeated attempts are performed before the head covering and eye mask are in a desired position on the head.

Another drawback of conventional head coverings used with eye masks is that the eye mask shifts relative to the head covering, since the eye mask is not directly connected to the head covering. For example, during aquatic activities, eye goggles frequently shift relative to the swimming cap, resulting in misalignment of the goggles with the eyes and the goggles filling with water. The swimmer must then stop to readjust the eye mask to the initial desired position relative to the swimming cap, which is undesirable, particularly during a race or timed event.

BRIEF DESCRIPTION OF THE INVENTION

In one embodiment of the invention, an assembly is provided for covering a head of a wearer of an eye mask including a mask strap extending along a back and sides of the head to secure the eye mask around the head. The assembly includes a head covering to cover at least a portion of the head with a first slot that extends from a left side to a right side of the covering. The head covering also includes a strap received within the first slot such that a first end of the strap is operatively connected to the mask strap on the left side of the covering and a second end of the strap opposite to the first end is operatively connected to the mask strap on the right side of the covering.

In another embodiment of the invention, an assembly is provided for covering a head of a wearer of an eye mask including a mask strap extending along a back and sides of the head to secure the eye mask around the head. The assembly includes a head covering to cover at least a portion of the head with a rear slot that extends along a rear side of the covering that receives the mask strap such that the mask strap extends from a left side of the covering to a right side of the covering through the rear slot. The head covering also includes a strap coupled to the covering and operatively connected to the mask strap on the left side and the right side of the covering.

In another embodiment of the invention, a method is provided for wearing a head covering and an eye mask including a mask strap extending along a back and sides of the head to secure the eye mask around the head. The method includes passing a strap through a slot in the covering that extends from a left side of the covering to a right side of the covering. The method further includes operatively connecting a first end of the strap to the mask strap on the left side of the covering. The method further includes operatively connecting a second end of the strap opposite to the first end to the mask strap on the right side of the covering. The method further includes simultaneously wearing the head covering and the eye mask on the head.

BRIEF DESCRIPTION OF THE DRAWINGS

FIG. 5 is a top view of a unitary piece of fabric material used to form the head covering of FIG. 1;

FIG. 6A is a cross-sectional view of the piece of fabric material of FIG. 5 taken along the line 6-6;

FIG. 6B is a cross-sectional view of the piece of fabric of FIG. 5 in accordance with an alternate embodiment of the assembly;

DETAILED DESCRIPTION OF THE INVENTION

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained.

Figure 1:
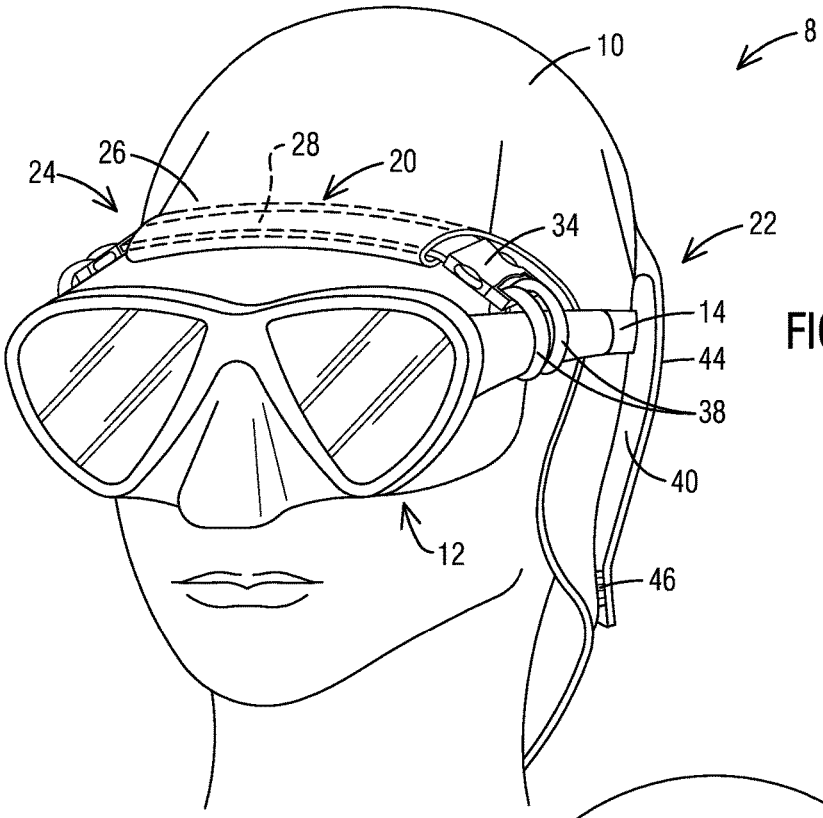
FIG. 1 is a front perspective view of an assembly in accordance with aspects of embodiments of the invention.
Figure 2:
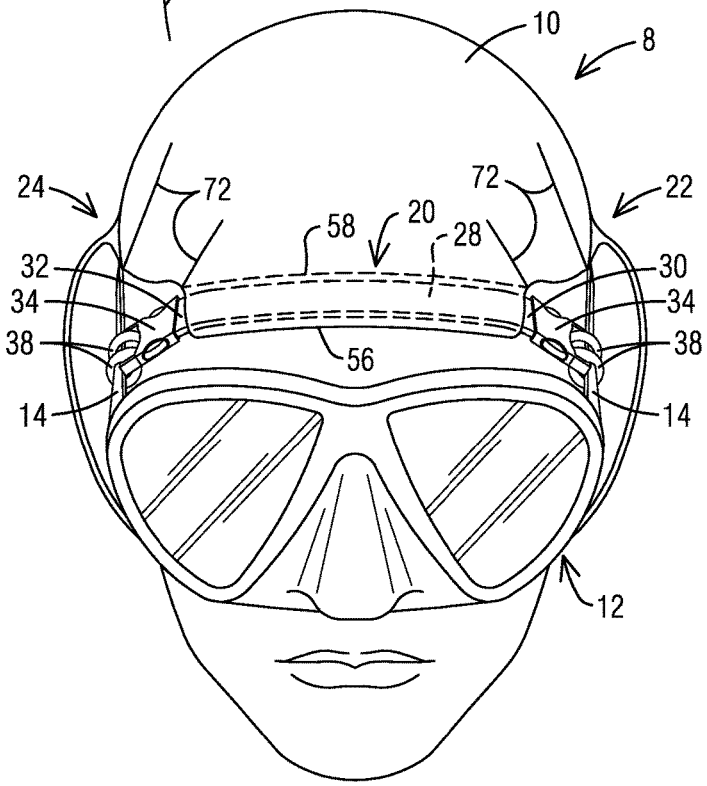
FIG. 2 is a top perspective view of the assembly of FIG. 1.

FIGS. 1-2 illustrate an assembly 8 for covering a head of a wearer of an eye mask 12 that includes a mask strap 14 that extends along a back and sides of the head to secure the eye mask 12 around the head. In one embodiment, the eye mask 12 is not a part of the assembly 8. The assembly 8 used with the eye mask 12 is applicable in a number of different contexts, including but not limited to, aquatic activities including swimming, snorkeling, and scuba diving, as well as medical treatment including surgical procedures, for example.

As illustrated in FIGS. 1-2, the assembly 8 includes a head covering 10 with a first slot, such as a front slot 20 that extends from a left side 22 of the covering 10 to a right side 24 of the covering 10. The left side 22 and right side 24 of the covering 10 are defined as those portions of the covering 10 positioned along a respective left side and right side of the head when the covering 10 is worn on the head. In an exemplary embodiment, the front slot 20 is in a front portion 26 of the covering 10 that is positioned along a forehead when the covering 10 is worn on the head. In another exemplary embodiment, the front slot 20 is in the front portion 26 of the covering 10 such that opposing ends of the first slot 20 are positioned adjacent to opposing temple regions of the head, when the covering 10 is worn on the head. However, the covering 10 is not limited to the slot 20 being positioned in the front portion 26 of the covering 10, and the slot 20 may be positioned in any portion of the covering 10, provided that the slot 20 extends from the left side 22 to the right side 24 of the covering 10.

As further illustrated in FIGS. 1-2, a strap 28 is received within the front slot 20 such that a first end 30 of the strap 28 is operatively connected to the mask strap 14 on the left side 22 of the covering 10 and a second end 32 of the strap 28 opposite to the first end 30 is operatively connected to the mask strap 14 on the right side 24 of the covering 10. In an exemplary embodiment, the first and second ends 30, 32 of the strap 28 are operatively connected to the mask strap 14 adjacent to opposing temple regions of the head. Although FIGS. 1-2 depict that only one strap 28 is received within the front slot 20 and operatively connected to the mask strap 14 on the left side 22 and right side 24 of the covering 10, more than one strap 28 may be received within the front slot 20 and operatively connected to the mask strap 14 on the left side 22 and right side 24 of the covering 10. In an exemplary embodiment, a plurality of straps 28 may be provided, where each strap 28 is received within a respective one of a plurality of slots 20 that extend from the left side 22 to the right side 24 of the covering 10 and where the plurality of straps 28 are operatively connected to the mask strap 14 on the left and right sides 22, 24 of the covering 10. In an exemplary embodiment, the strap 28 is made from elastic material such as headband elastic, has a width in a range of ⅜"-½" and has a length in a range of 3-5".

In an exemplary embodiment, straps 28 of various lengths can be positioned within the front slot 20, to accommodate slots 20 and head coverings 10 of various sizes. For example, a long strap 28 may be selected, to accommodate a large sized slot 20 and head covering 10 that is used for a large sized head, and a short strap 28 may be selected, to accommodate a small sized slot 20 and head covering 10 that is used for a small sized head. In another exemplary embodiment, the strap 28 has an adjustable length, to fit a range of sizes of slots 20 and head coverings 10 to accommodate a range of sized heads. For example, one or more slide adjusters can be positioned along the strap 28, so that the length of the strap is adjustable. Although FIGS. 1-2 depict that the strap 28 is received within the front slot 20, the strap 28 need not be received within a slot of the head covering 10, provided that the strap 28 is coupled to the head covering 10 and that the strap 28 is connected to the mask strap 14 on the left and right sides 22, 24 of the covering 10.

Figure 3:
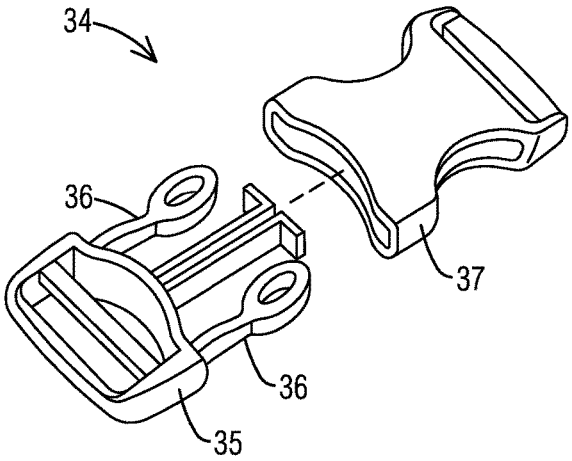
FIG. 3 is an exploded view of a buckle fastener used in the assembly of FIG. 1.

The first end 30 and second end 32 of the strap 28 are detachably connected to the mask strap 14 on the left and right sides 22, 24 of the head covering 10. As illustrated in FIGS. 1-2, the first and second ends 30, 32 of the strap 28 are each detachably connected to the mask strap 14 with a buckle fastener 34. As illustrated in FIG. 3, the buckle fastener 34 includes a male buckle member (or hook end) 35 with a pair of spring arms 36 that are detachably received within a female buckle member (or catch end) 37. In an exemplary embodiment, the male buckle member 35 of the buckle fastener 34 is secured to each first and second end 30, 32 of the strap 28 and the female buckle member 37 is secured to the mask strap 14 on the left and right side 22, 24 of the covering 10 with an elastic strap 38. In an exemplary embodiment, the elastic strap 38 forms a loop through which the female buckle member 37 is pulled to create a square knot between the female buckle member 37 and the mask strap 14. In an exemplary embodiment, the elastic strap 38 is bungee cord material. In another exemplary embodiment, the female buckle member 37 of the buckle fastener 34 is secured to each first and second end 30, 32 of the strap 28 and the male buckle member 35 is secured to the mask strap 14 on the left and right side 22, 24 of the covering 10 with the elastic strap 38. In an exemplary embodiment, the elastic strap 38 has a length in a range of 1-2", has a first end connected to the mask strap 14 and a second end opposite to the first end that is connected to the female buckle member 37. Although FIG. 1 depicts that the first and second ends 30, 32 of the strap 28 are detachably connected to the mask strap 14 with the buckle fastener 34, any fastener can be used to detachably connect the first and second ends 30, 32 of the strap 28 to the mask strap 14, such as a clasp fastener, for example.

Figure 4:
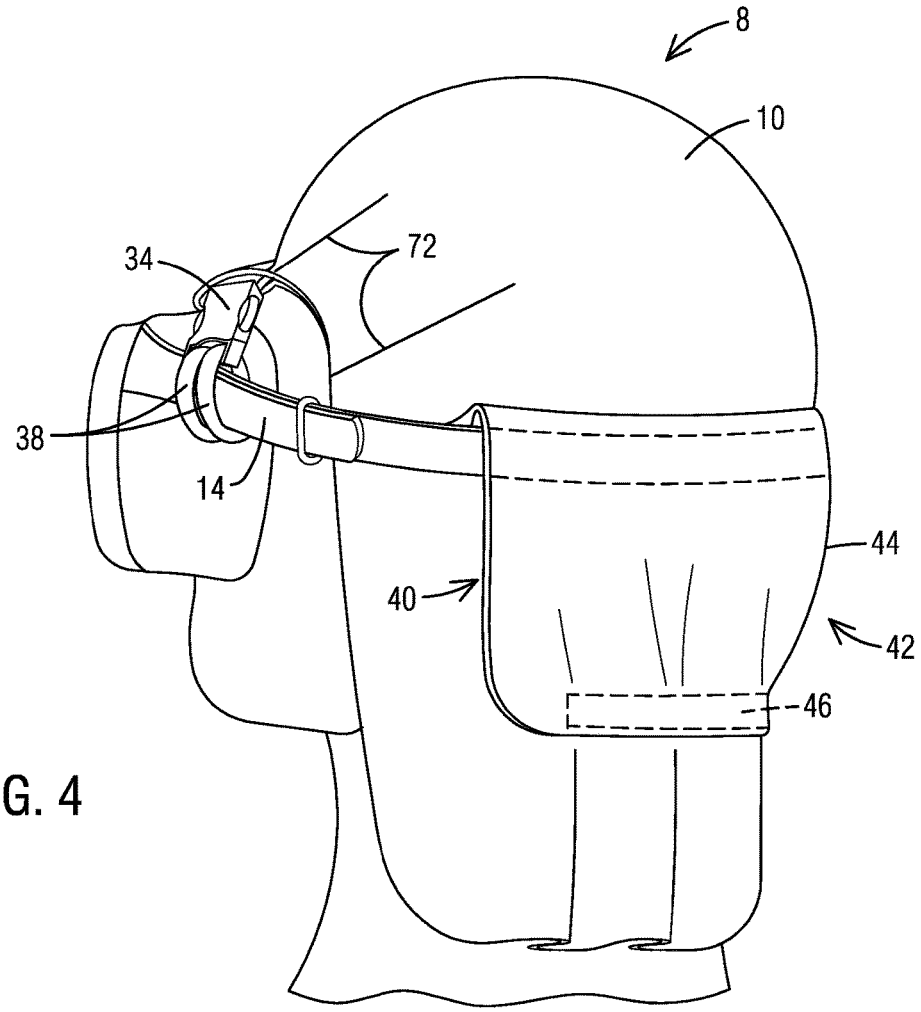
FIG. 4 is a rear perspective view of the assembly of FIG. 1.

As illustrated in FIG. 4, the head covering 10 includes a second slot, such as a rear slot 40 that extends along a rear side 42 of the covering 10. The rear side 42 of the covering 10 is defined as that portion of the covering 10 positioned along a rear side of the head when the covering 10 is worn on the head. The rear slot 40 is configured to receive the mask strap 14 such that the mask strap 14 extends from the left side 22 of the covering 10 to the right side 24 of the covering 10 through the rear slot 40. As further illustrated in FIG. 4, the rear slot 40 is formed by a rear flap 44 of the covering 10 that is removably attached to the covering 10 with a hook and loop fastener 46, such as Velcro®, for example. However, the rear slot 40 is not limited to this configuration and may be formed by the rear flap 44 being fixedly attached to the covering 10. As further illustrated in FIG. 4, the covering 10 extends over the nape of the neck, to protect the nape of the neck. In an exemplary embodiment, the covering 10 is used during outdoor aquatic activities and extends over the nape of the neck, to protect the nape of the neck from sunlight radiation. In one embodiment, a strip is provided in the rear slot 40 between the covering 10 and the mask strap 14, to provide additional comfort. In an exemplary embodiment, the strip is sewn to the covering 10 and has dimensions that at minimum cover a region where the mask strap 14 makes contact with the head covering 10. In an exemplary embodiment, the strip has dimensions of 3" wide by 5" long. In another exemplary embodiment, the strip is a neoprene strip to provide comfort and buoyancy. However, the head covering 10 need not include the strip.

In an alternate embodiment, a Croakie® strap (not shown) is sewn along the rear side 42 of the covering 10. As appreciated by one skilled in the art, the Croakie® strap includes a first and second end with openings to removably attach left and right temples of eyewear, such as sunglasses, for example. In this embodiment, glasses are used with the covering 10 instead of the eye mask 12 depicted in FIGS. 1-2, including sunglasses or glasses worn by medical professionals, for example.

FIG. 5 is a top view of a piece of fabric material 50 that is used to form the head covering 10 of FIG. 1. In an exemplary embodiment, the piece of fabric material 50 has a width 51 in a range of 12-16" and a length 53 in a range of 19-23". In an exemplary embodiment, the piece of fabric material 50 is a unitary piece of fabric material. In an exemplary embodiment, where the head covering 10 is used during aquatic activities, the piece of fabric material 50 is made from four way stretch lycra material, for example. In an exemplary embodiment, where the head covering 10 is used during aquatic activities, the piece of fabric material 50 is made from sun protective fabric with an Ultraviolet Protection Factor (UPF) of at least 30, such as 50, for example, to protect the head from sun radiation including ultra-violet (UV) radiation. In another exemplary embodiment, where the head covering 10 is used by medical personnel during medical treatments, the piece of fabric material 50 is made from non-woven fabric material such as antimicrobial and antibacterial fabric, to provide a sterile barrier with the medical treatment area. In an exemplary embodiment, a plurality of pieces of fabric material 50 may be colored with a unique color and used to form a plurality of head coverings 10 of the same unique color, such that individuals within a group wearing the head coverings 10 can be commonly identified as within the group. For example, members of a swimming team, members of a snorkeling team or members of a surgical team wearing the common-colored coverings 10 can be identified as within their respective group.

FIG. 6A is a cross-sectional view of the piece of fabric material 50 of FIG. 5 taken along the line 6-6. As illustrated in FIGS. 5 and 6A, the front slot 20 of the head covering 10 is formed by a front flap 54 of the piece of fabric material 50 that is folded over and stitched to the covering 10 with a pair of spaced apart stitch lines 56, 58 that extend from the left side 22 to the right side 24 of the covering 10. In an exemplary embodiment, stitching parameters of the stitch lines 56, 58, such as spacing of the threads from the left side 22 to the right side 24 of the covering 10 and the type of thread used may vary depending on the type of fabric material 50. In an exemplary embodiment, the fabric material 50 is stitched with a Serger® machine using a serged overlock stitch with bonded nylon thread material and a stitch spacing between 33 and 46. As illustrated in FIG. 6A, the front slot 20 is formed between the spaced apart stitch lines 56, 58. In an exemplary embodiment, the width 60 of the front slot 20 between the stitch lines 56, 58 is in a range of 0.5-2". In an exemplary embodiment, the length 62 (FIG. 5) of the front slot 20 is in a range of 5-7". Although FIG. 6A illustrates that the front slot 20 is formed between the spaced apart stitch lines 56, 58, the front slot 20 is not limited to this arrangement. FIG. 6B illustrates an alternate embodiment of a head covering 10', where the front slot 20' is formed between a crease 64 where the front flap 54 is folded and a single stitch line 56' in the front flap 54 that extends from the left side 22 to the right side 24 of the covering 10'. In an exemplary embodiment, the width 60 of the front slot 20' is similar to the width 60 of the front slot 20.

As further illustrated in FIG. 5, the rear flap 44 is removably attached to the covering 10 with the hook and loop fastener 46, to form the rear slot 40. In an exemplary embodiment, the length 65 of the rear slot 40 is in a range of 8-12" and a width 67 of the rear slot 40 is in a range of 6-7". In an exemplary embodiment, a first portion of the hook and loop fastener 46 extends a length 47 along the inner surface of the rear flap 44 and a second portion of the hook and loop fastener 46 extends the length 47 along the surface of the covering 10. In an exemplary embodiment, the length 47 is in a range of 3-5".

As further illustrated in FIG. 5, the piece of fabric material 50 includes a pair of regions 66 in a top portion of the piece of fabric material 50 and a pair of regions 68 in a middle-portion of the piece of fabric material 50, where stitching contours 70 of the regions 66, 68 are stitched together to form stitch lines 72 (FIG. 2) along the covering 10. The dimensions of the regions 66, 68 are adjusted, such that once the stitching contours 70 are stitched together, the covering 10 fits a range of head sizes. In an exemplary embodiment, the regions 66 are defined by an arc-length 74 in a range of 2-3" and a depth 76 in a range of 2-3". In an exemplary embodiment, the cut-out regions 68 are defined by an arc-length 78 in a range of 5-7" and a depth 80 in a range of 4-5".

Figure 7:
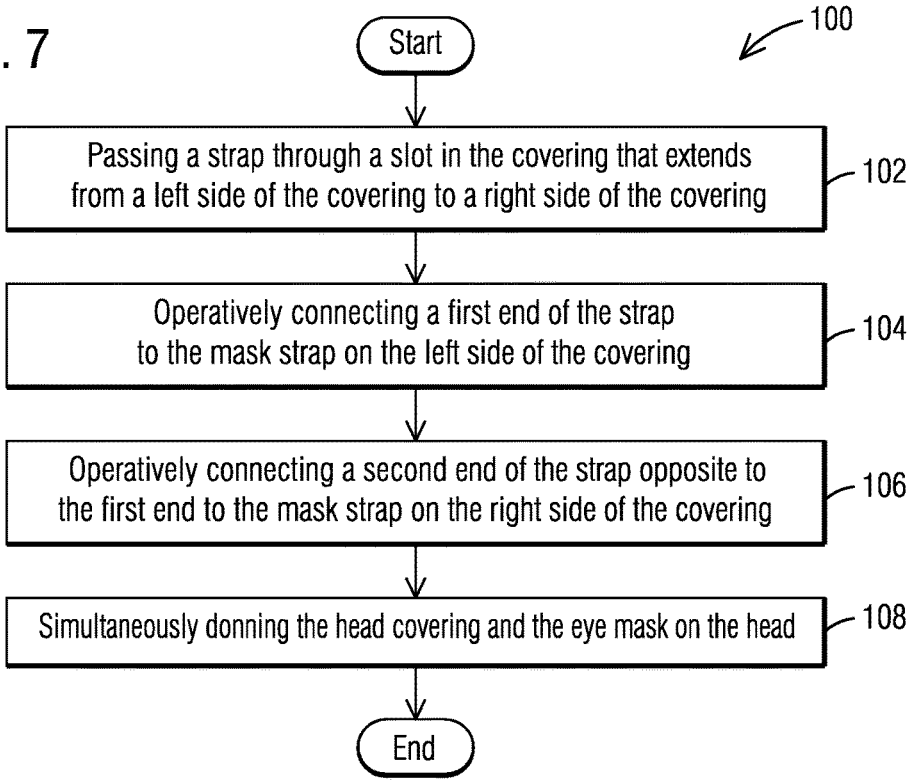
FIG. 7 is a flowchart depicting a method for wearing a head covering and an eye mask in accordance with aspects of embodiments of the invention.

FIG. 7 is a flowchart depicting a method 100 for wearing the head covering 10 and the eye mask 12 in accordance with aspects of embodiments of the invention. In step 102, the strap 28 is passed through the front slot 20 in the head covering 10 from the left side 22 of the head covering 10 to the right side 24 of the head covering 10. In an exemplary embodiment, in step 102, the strap 28 is selected, such that upon passing the strap 28 through the front slot 20, the first and second ends 30, 32 of the strap 28 extend outside the front slot 20 on the respective left and right sides 22, 24 of the head covering 10.

In step 104, the first end 30 of the strap 28 is operatively connected to the mask strap 14 on the left side 22 of the covering. In an exemplary embodiment, in step 104, the male buckle member 35 at the first end 30 of the strap 28 is received within the female buckle member 37 that is connected to the mask strap 14 with the elastic strap 38. In an exemplary embodiment, in step 104, a length of the elastic strap 38 is optionally adjusted between the mask strap 14 and the female buckle member 37, to achieve a desired separation between the mask strap 14 and the first end 30 of the strap 28. In an exemplary embodiment, the desired separation between the mask strap 14 and the first end 30 is less than 1", for example.

In step 106, the second end 32 of the strap 28 is operatively connected to the mask strap 14 on the right side 24 of the covering. In an exemplary embodiment, in step 106, the male buckle member 35 at the second end 32 of the strap 28 is received within the female buckle member 37 that is connected to the mask strap 14 with the elastic strap 38. In an exemplary embodiment, in step 106, a length of the elastic strap 38 is optionally adjusted between the mask strap 14 and the female buckle member 37, to achieve a desired separation between the mask strap 14 and the second end 32. In an exemplary embodiment, the desired separation between the mask strap 14 and the second end 32 is less than 1", for example.

In step 108, the head covering 10 and eye mask 12 are simultaneously worn on the head. After steps 102, 104, 106, the head covering 10 and eye mask 12 are connected together. During step 108, the rear flap 44 is disengaged from the hook and loop fastener 46. The mask strap 14 is then extended around the rear side 42 of the head covering 10. The rear flap 44 is then engaged with the hook and loop fastener 46, to form the rear slot 40 such that the mask strap 14 passes from the left side 22 of the head covering 10 to the right side 24 of the head covering 10 through the rear slot 40. The interconnected head covering 10 and eye mask 12 are then simultaneously positioned around the head, with the mask strap 14 sitting on a comfortable portion on the rear side of the head between the crown of the head and the nape of the neck. In an exemplary embodiment, the eye mask 12 is positioned over the eyes with a first hand, after which a second hand is used to simultaneously position the head covering 10 and mask strap 14 on the head.

In an exemplary embodiment, while wearing the head covering 10 and the eye mask 12, the eye mask 12 can be optionally removed without removing the head covering 10 using the following steps. The male buckle members 35 on the ends 30, 32 of the strap 28 are first disconnected from the female buckle members 37 on the mask strap 14 on each side 22, 24 of the head covering 10. The eye mask 12 can later be re-worn using the following steps. The mask strap is positioned around the rear side 42 of the head covering 10. The rear flap 44 is then re-engaged with the hook and loop fastener 46 to form the rear slot 40 such that the mask strap 14 passes from the left side 22 to the right side 24 of the head covering 10. The male buckle members 35 on the ends 30, 32 of the strap 28 are then re-connected to the female buckle members 37 on the mask strap 14 on each side 22, 24 of the head covering 10.

Figure 8:
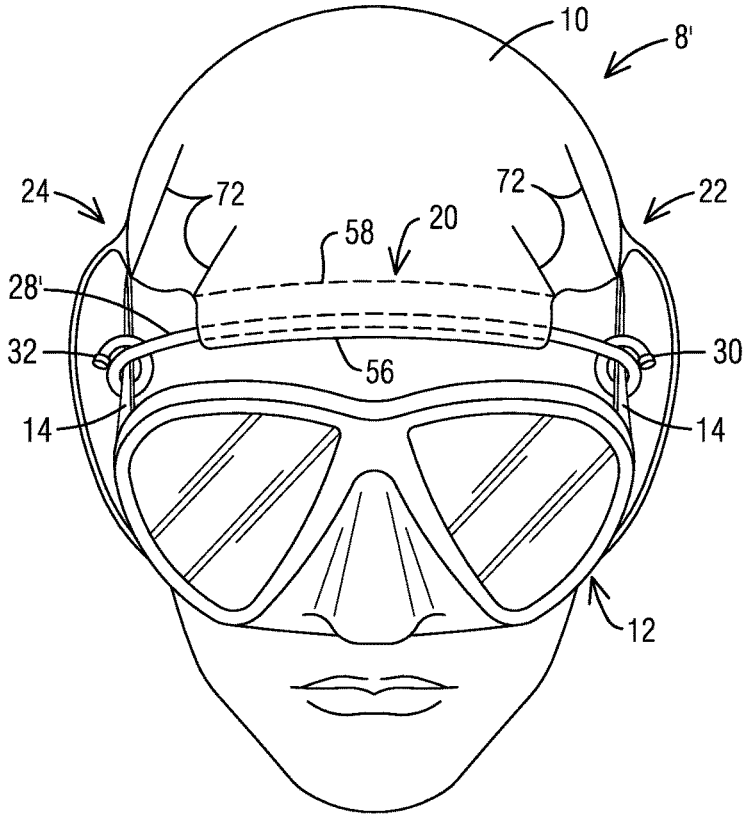
FIG. 8 is a top perspective view of an assembly in accordance with aspects of embodiments of the invention.

FIG. 8 is a top perspective view of an assembly 8' in accordance with aspects of embodiments of the invention. The assembly 8' is similar to the assembly 8 discussed above, except that a strap 28' is received within the front slot 20 of the head covering 10. Unlike the embodiment of FIGS. 1-2, where the first and second ends 30, 32 of the strap 28 are operatively connected to the mask strap 14 using buckle fasteners 34, in the embodiment of FIG. 8, the first and second ends 30, 32 of the strap 28' directly connect to the mask strap 14 on the left and right sides 22, 24 of the heading covering 10. In one embodiment, the strap 28' comprises a strong bendable wire interior and a sturdy rubber exterior shell, such that the strap 28' maintains a bent shape. In one embodiment, the strap 28' maintains a bent shape along the front slot 20, to conform to the contours of the forehead. To connect the strap 28' to the mask strap 14 on the left and right sides 22, 24 of the head covering 10, each of the first and second ends 30, 32 are bent around a portion of the mask strap 14 on the left and right side 22, 24 of the head covering 10, to rigidly connect the strap 28' to the mask strap 14 on the left and right sides 22, 24. In an example embodiment, the strap 28' is a Gear Tie® made by Nite Ize®. In an example embodiment, the strap 28' has a length in a range of 10-14 inches.

While certain embodiments of the present invention have been shown and described herein, such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An assembly for covering a head of a wearer of an eye mask including a first strap extending along a back and sides of the head to secure the eye mask around the head, said assembly comprising:

a head covering configured to cover at least a portion of the head;

a first slot that extends from a left side to a right side of the head covering; and a second strap received within the first slot such that a first end of the second strap is operatively connected to the first strap on the left side of the head covering and a second end of the second strap opposite to the first end is operatively connected to the first strap on the right side of the head covering, wherein the second strap is different than the first strap.

2. The assembly of claim 1, wherein the first slot is in a front portion of the head covering positioned along a forehead when the head covering is worn on the head.

3. The assembly of claim 1, wherein the second strap is detachable from the first strap.

4. The assembly of claim 1, wherein only one second strap is operatively connected to the first strap on the left side of the head covering and the right side of the head covering.

5. The assembly of claim 1, wherein the first and second ends of the second strap are operatively connected to the first strap with a buckle fastener.

6. The assembly of claim 5, wherein a first portion of the buckle fastener is secured to the first and second ends of the second strap and a second portion of the buckle fastener is secured to the first strap with an elastic strap.

7. The assembly of claim 1, wherein the head covering including the first slot is formed from a unitary piece of fabric material and wherein the first slot is formed by a front flap of the unitary piece of fabric material folded over and stitched to the head covering with at least one stitch line that extends from the left side to the right side of the head covering.

8. The assembly of claim 1, further comprising a second slot that extends along a rear side of the head covering, wherein the second slot is configured to receive the first strap such that the first strap extends from the left side of the head covering to the right side of the head covering through the second slot.

9. The assembly of claim 1, wherein the first and second ends of the second strap are directly connected to the first strap.

10. The assembly of claim 9, wherein the second strap comprises a bendable wire configured to maintain a bent shape and wherein the first and second ends of the second strap comprise the bent shape around a portion of the first strap on the respective left and right sides of the head covering.

11. An assembly for covering a head of a wearer of an eye mask including a first strap extending along a back and sides of the head to secure the eye mask around the head, said assembly comprising:

a head covering configured to cover at least a portion of the head;

a rear slot that extends along a rear side of the head covering, wherein the rear slot is configured to receive the first strap such that the first strap extends from a left side of the head covering to a right side of the head covering through the rear slot; and at least one second strap coupled to the head covering, said at least one second strap operatively connected to the first strap on the left side and the right side of the covering, wherein the second strap is different than the first strap.

12. The assembly of claim 11, wherein the at least one second strap is coupled to a front portion of the head covering positioned along a forehead when the head covering is worn on the head.

13. The assembly of claim 11, wherein the at least one second strap is detachable from the first strap.

14. The assembly of claim 11, wherein the at least one second strap is operatively connected to the first strap with a buckle fastener.

15. The assembly of claim 11, wherein only one second strap is operatively connected to the first strap on the left side and the right side of the head covering.

16. The assembly of claim 11, further including a front slot that extends in a front portion of the head covering from the left side to the right side of the head covering, said front portion of the head covering positioned along a forehead when the head covering is worn on the head, wherein the at least one second strap is received within the front slot.

17. The assembly of claim 16, wherein the front slot is formed by a front flap of the head covering folded over and stitched to the head covering with at least one stitch line.

18. The assembly of claim 11, wherein the rear slot is formed by a rear flap of the head covering that is removably attached to the head covering with a hook and loop fastener.

19. The assembly of claim 11, wherein the at least one second strap is directly connected to the first strap on the left side and the right side of the head covering.

20. A method for wearing a head covering and an eye mask including a first strap extending along a back and sides of the head to secure the eye mask around the head, said method comprising:

passing a second strap through a slot in the head covering that extends from a left side of the head covering to a right side of the head covering, wherein the second strap is different than the first strap;

operatively connecting a first end of the second strap to the first strap on the left side of the head covering;

operatively connecting a second end of the second strap opposite to the first end to the first strap on the right side of the head covering; and simultaneously wearing the head covering and the eye mask on the head.

* * * * *